US009585506B2

(12) United States Patent
Casey-Mederios et al.

(10) Patent No.: US 9,585,506 B2
(45) Date of Patent: Mar. 7, 2017

(54) BRA HANGER

(71) Applicants: Peg Casey-Mederios, Winthrop, MA (US); Mairead Mederios, Winthrop, MA (US); Frank Mederios, Winthrop, MA (US)

(72) Inventors: Peg Casey-Mederios, Winthrop, MA (US); Mairead Mederios, Winthrop, MA (US); Frank Mederios, Winthrop, MA (US)

( * ) Notice: Subject to any disclaimer, the term of this patent is extended or adjusted under 35 U.S.C. 154(b) by 550 days.

(21) Appl. No.: 14/079,999

(22) Filed: Nov. 14, 2013

(65) Prior Publication Data

US 2015/0133029 A1 May 14, 2015

(51) Int. Cl.
*A47G 25/18* (2006.01)
*A47G 25/14* (2006.01)

(52) U.S. Cl.
CPC ..... *A47G 25/18* (2013.01); *A47G 2025/1492* (2013.01); *A47G 2200/106* (2013.01)

(58) Field of Classification Search
CPC .... A47G 25/28; A47G 25/16; A47G 25/0614; A47G 25/0607; A47F 5/0006
See application file for complete search history.

(56) References Cited

U.S. PATENT DOCUMENTS 1,482,253 A * 1/1924 Perrine ..... A47G 25/20 223/68
2,162,168 A * 6/1939 Eboli ..... B65D 85/18 206/284
2,601,926 A 7/1952 Speaker et al.
D190,608 S * 6/1961 Forrester ..... 211/119
3,212,647 A 10/1965 Meyer et al.
3,705,653 A 12/1972 Pereyra
4,029,212 A 6/1977 Uadiski
4,058,222 A 11/1977 Singer
4,278,177 A 7/1981 Fahmi
5,117,988 A * 6/1992 Daniels ..... A47G 25/06 211/113
6,026,998 A 2/2000 Brooks
6,158,593 A * 12/2000 Olsen ..... A63B 47/00 206/315.9
7,481,340 B2 1/2009 Murphy
7,624,900 B2 12/2009 McLaughlin
D608,099 S 1/2010 Mangano
RE44,481 E * 9/2013 Murphy ..... 223/85
2006/0016841 A1* 1/2006 Shurm ..... A45F 5/00 224/222
2007/0119881 A1* 5/2007 Murphy ..... A47G 25/743 223/97
2008/0090491 A1* 4/2008 Liu ..... A41C 3/0014 450/39
2008/0197161 A1* 8/2008 McLaughlin ..... A47G 25/32 223/89
2010/0025442 A1* 2/2010 Shurm ..... A45F 5/00 224/183

(Continued)

*Primary Examiner* — Shaun R Hurley
*Assistant Examiner* — Andrew W Sutton
(74) *Attorney, Agent, or Firm* — Lambert & Associates; Gary E. Lambert; David J. Connaughton

(57) ABSTRACT

A magnetic bra hanger is provided. The bra hanger is configured to magnetically receive an underwire of a bra to attach the bra to the hanger. The bra hanger may be configured to hang a single bra, or a plurality of bras.

20 Claims, 4 Drawing Sheets

(56) References Cited

U.S. PATENT DOCUMENTS

| | | | | |
|---|---|---|---|---|
| 2010/0051654 | A1* | 3/2010 | Thompson | A47G 25/743<br>223/88 |
| 2012/0292209 | A1* | 11/2012 | Willey | A47G 25/14<br>206/279 |
| 2014/0144952 | A1* | 5/2014 | Prado | A47G 25/18<br>223/120 |

* cited by examiner

BRA HANGER

BACKGROUND OF THE INVENTION

Field of the Invention

The present invention relates generally to devices for properly storing women's bras. More particularly the present invention relates to a magnetic hanger device to hang women's bras on by magnetic attraction of an underwire of a bra to a magnet.

Description of Related Art

Traditionally, women's bras are stored in a drawer, box, or the like. While this may be a convenient and simple method of storage, storage in this manner eventually damages the bras, resulting in a shortened life of the bra. Generally, during storage in the drawer, the bras are stacked together and/or mixed in with other undergarments, shirts, pants, and the like. As such, the cups of the bras are often crushed, folded, bent, or otherwise deformed from their natural shape. This causes the cup material to become damaged, resulting in wrinkles, bumps and other deformations. These deformations can often be seen through thin shirts, and at this point a bra must be discarded.

Therefore, what is needed is a device that may efficiently and conveniently store bras without causing damage from deformation of the bra or similar improper storage.

SUMMARY OF THE INVENTION

The subject matter of this application may involve, in some cases, interrelated products, alternative solutions to a particular problem, and/or a plurality of different uses of a single system or article.

In one aspect, a magnetic bra hanger is provided. The bra hanger comprises a hanger allowing the device to be hung from a door, closet rack or bar, and the like. A magnetic hanging area is attached to the hanger and provides a space for a bra or bras to be magnetically attached. The magnetic hanging area comprises a quantity of material defining the area, and at least one magnet attached to the material. This magnet is configured to be able to attract and hold an underwire of the bra. In particular, the magnet should be able to, alone, or in combination with other magnets, hold up the bra via magnetic attraction to the underwire.

In another aspect, a magnetic bra hanger is provided. The bra hanger comprises a hanger allowing the device to be hung from a door, closet rack or bar, and the like. A magnetic hanging area is attached to the hanger and provides a space for a bra or bras to be magnetically attached. The magnetic hanging area is formed as a grid of bars such as wires, plastic strips, fabric strips, and the like. The grid has an outer perimeter, one or more horizontal bars, and one or more vertical bars. A magnet or magnets may be attached to the grid, for example along the bars or at an intersection of the bars. This magnet is configured to be able to attract and hold an underwire of the bra.

In yet another aspect, a magnetic bra hanger is provided formed of a base panel, and a plurality of magnets arranged in rows attached to the base panels. A bra or a plurality of bras may be attached to the hanger by magnetic attachment to the magnets. In a particular embodiment, the magnets may be positioned such that they attract and hold both underwires of the bra or bras.

DETAILED DESCRIPTION

Figure 1:
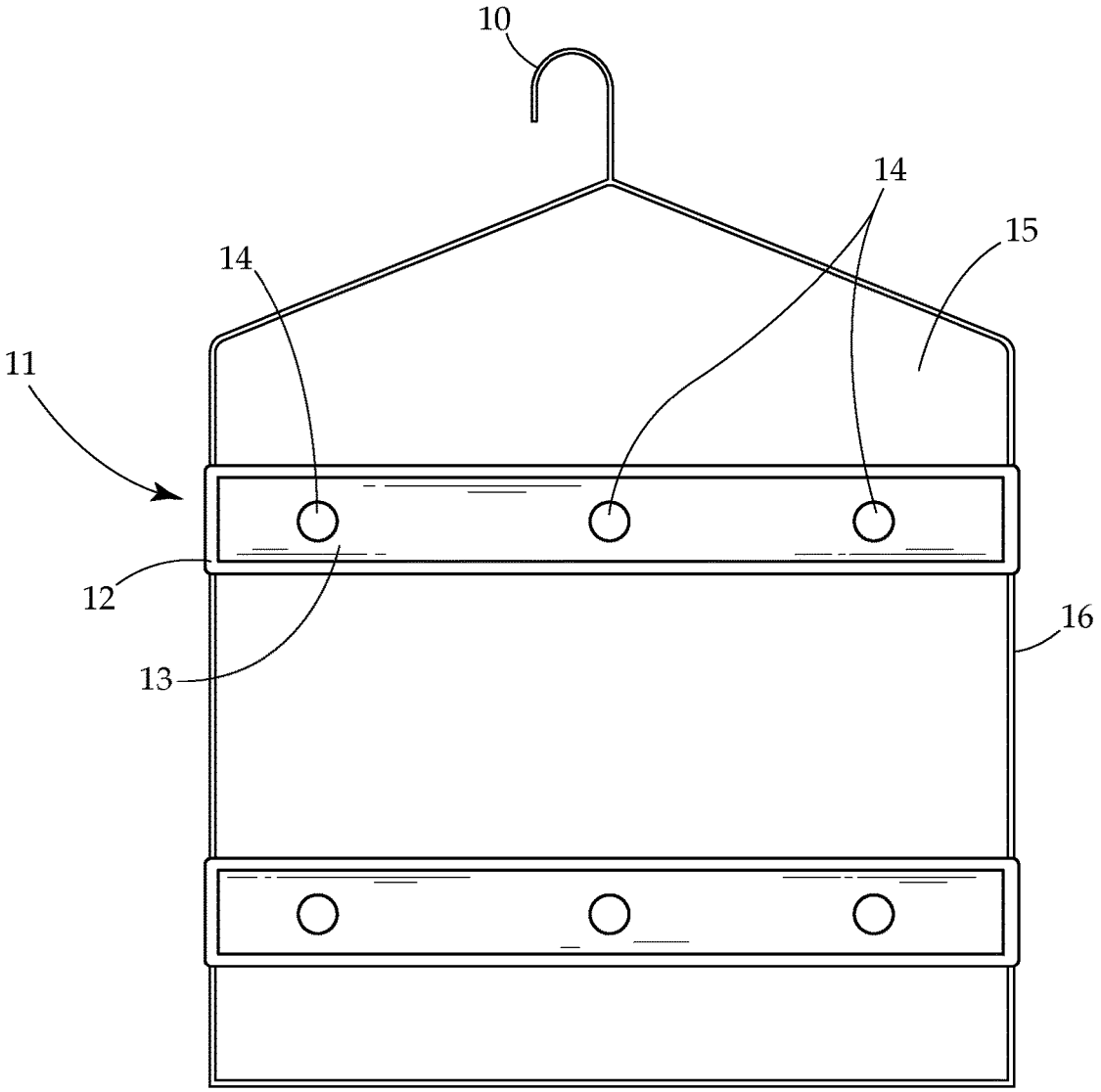
FIG. 1 provides an elevation view of an embodiment of the bra hanger.

The detailed description set forth below in connection with the appended drawings is intended as a description of presently preferred embodiments of the invention and does not represent the only forms in which the present invention may be constructed and/or utilized. The description sets forth the functions and the sequence of steps for constructing and operating the invention in connection with the illustrated embodiments.

Generally, the present invention concerns a bra hanger utilizing magnets to attract and hold an underwire of the bra. The hanger may have one or a plurality of magnets arranged in one or more rows, each row configured to align with an underwire of a bra. The magnet or plurality of magnets, along with the supporting material thus forms a magnet hanging area. The hanger is further configured to hang to a door, closet rack, bar, or the like, and is equipped with proper hanging equipment.

A shortcoming experienced by most bra storage systems and methods employed by users is that the bras become crumpled and wrinkled, particularly by deformation of the bra cup. These wrinkles show through clothing and cause an unsightly appearance. The wrinkling essentially ruins the bras, causing them to need to be disposed of, and requiring users to replace their bras. The bra hanger contemplated herein greatly extends the life of the bras by not requiring them to be crumpled or wrinkled during storage. Further, the life of the bra is extended by the present invention hanging them from the most durable area of the bra, instead of a flexible fabric part. Moreover, the bra hanger allows for easy organization of the bras, and allows for better visual selection than can be achieved by storing the bras in a drawer.

The hanger may be any structure allowing the bra hanger to be attached to another object or surface. In one embodiment, the hanger may be a hook sized to receive a closet hanging bar or rack. In another embodiment, the hanger may be a hook sized to fit over a door. In yet another embodiment, the hanger may be equipment configured to be nailed, screwed, bolted, or otherwise attached to a surface such as a door, wall, or the like. In still another embodiment, the rows of magnets forming the magnet hanging area may have a hanger configured as hanging equipment configured to mount the magnet hanging area directly to a substantially flat surface, such as on its corners, sides, top and/or bottom.

The hanger may be formed from any material capable of supporting the bra hanger and one, or a plurality of bras attached to the magnetic hanging area. Examples of materials of which the hanger may be made include, but are not limited to, metals, plastics, wood, composite materials, fabrics, and the like.

The magnetic hanging area may be any orientation and configuration allowing a bra underwire to be magnetically held to the bra hanger. In one embodiment, only one of the two cups may be magnetically attached to the hanger. In another embodiment, both cups can be magnetically attached to the hanger. The magnets may be oriented such that the bras may be hung vertically, or horizontally. Further, the magnetic hanging area may be any size, allowing for one or more bras to be hung. In a particular embodiment, the magnetic hanging area may have at least two disc shaped magnets along a horizontal plane to hold underwires of both bra cups. This particular embodiment may have any number of rows of either horizontal or vertical orientation, to hold any number of bras.

In one embodiment, the magnetic hanging area may be supported and defined by a framing. The framing may define an outline of edges of the hanging area of the hanger, and in some embodiments may provide internal structure, such as a grid structure formed by horizontal and/or vertical bars supporting the row or rows of magnets. This framing may be formed of metal, plastic, or the like.

In another embodiment, the hanger may form a base from which the magnetic hanging area hangs. In this embodiment, the magnetic hanging area may be formed by a sheet material such as fabric, plastic, wood, metal, composite materials, or the like. The sheet may have magnets attached to its surface or embedded in its surface. The sheet and magnets thus form the magnetic hanging area. In a further embodiment, a plurality of sheets may be used. In embodiments having a sheet made at least partially of magnetic metal, the magnets may be magnetically attached to a surface of the metal sheet.

In one embodiment, the sheet may be a flexible sheet. In this embodiment, the magnetic hanging area may be rolled or folded up into a compact position. As such, the hanger may be easily compacted for convenient storage, travel, moving, and the like.

In an alternative embodiment, the magnetic hanging area may be covered by, or integrated into, a wood panel. The wood panel may be a door or a section integrated to a door, or a general wood panel. In a particular embodiment, the hanger may be formed solely as a magnetic array and integrated into a door, closet wall, sheet, or the like. Further, this magnetic array may be attached to a slideable rail or the like to allow it to be slid between a storage position and selecting position. For example, the array may slide back into a closet when not in use, and be drawn outwards for easier access. Further still, the slideable rail may additionally allow pivoting.

The magnets used for the hanger may be any type of magnet capable of supporting a bra's weight by magnetic attraction of at least one underwire of the bra. Traditional permanent magnets such as Alnico, ceramic or ferrite magnets may be used. Additionally, high strength permanent magnets such as Neodymium magnets or Samarium Cobalt magnets may be used. In particular embodiments, electromagnets may be used as an alternative to the permanent magnets above. Disc shaped magnets or strips of magnetic material may be particularly applicable.

The magnet or magnets may be oriented in any manner. For example, small disc or flat magnets may be positioned where an underwire is intended to be held. In another example, an elongate magnetic strip may extend along or partially along a height or width of the magnetic hanging area where an underwire is intended to be held.

In embodiments of the bra hanger having a plurality of rows of magnets, the magnets may be spaced away from each other sufficiently to allow the bras to fit in an attached position. The attached position may vary from a nearly horizontal position of the bra, allowing a maximum number of bras to be hung, to a vertical or nearly vertical position of the bra, limiting number of bras but enhancing ease of use and appearance. In some embodiments, magnet spacing may be selected specifically to facilitate hanging.

A strap attachment mechanism may be attached to the magnetic bra hanger. This strap attachment mechanism may be any device capable of neatly holding the bra straps when the bra is magnetically attached to the hanger. Examples of strap attachment mechanisms may include, but are not limited to, hooks, a device to wrap the straps around, an area to tuck the straps, a snap to hold the straps, clips, additional magnets, and the like.

Turning now to FIG. 1, a view of one embodiment of the magnetic bra hanger is provided. In this embodiment, a hanger 10 is configured as a hook sized to fit over a door, closet rack, bar, or the like. A magnetic hanging area 15 is defined by wire 16 that forms a partially rectangular border and attaches to the hanger 10. Two bra receivers 11 span the magnetic hanging area 15 and connect to the wire 16. Each bra receiver 11 comprises a border 12 surrounding an edge of a plate 13. The plate 13 has three magnets 14 attached thereto for receiving an underwire of a bra (not shown).

Figure 2:
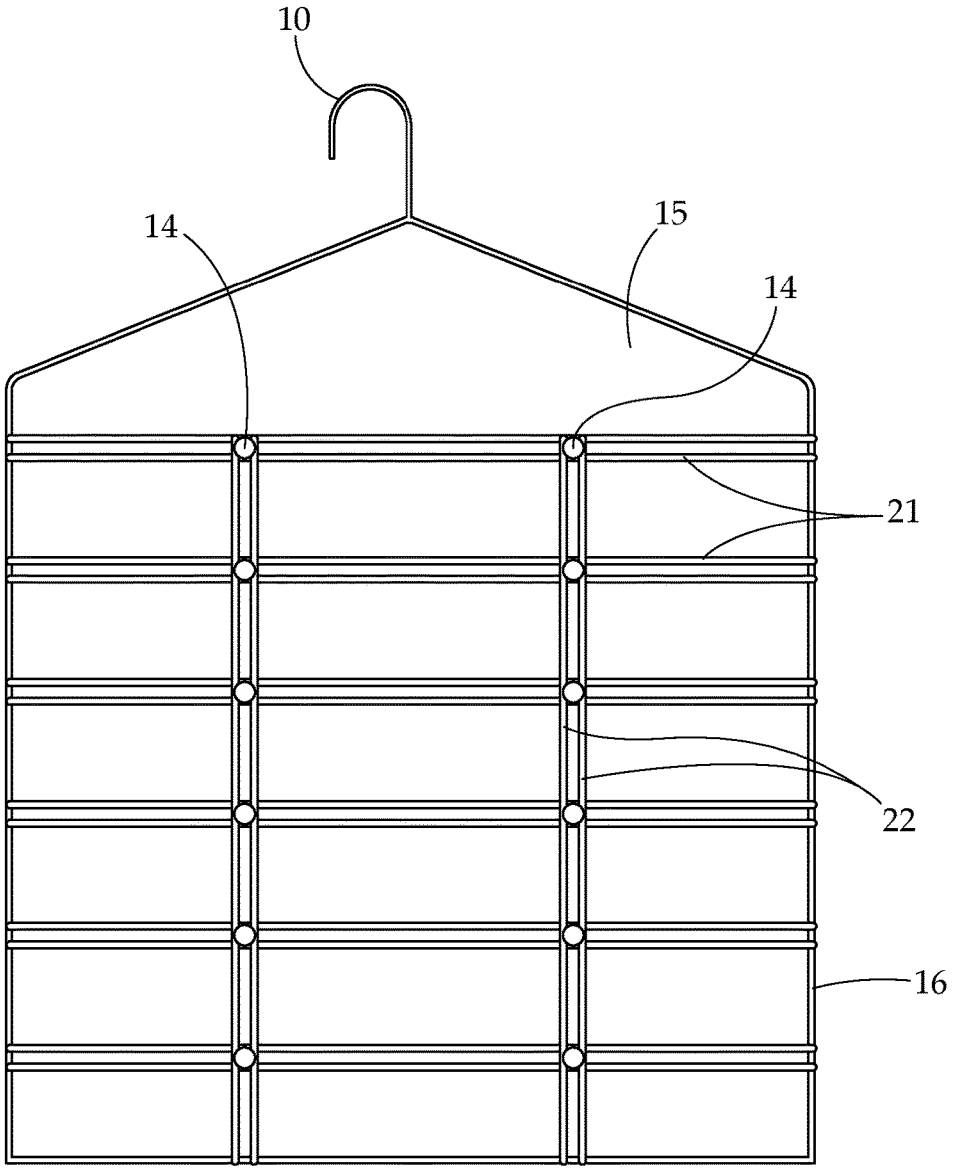
FIG. 2 provides an elevation view of another embodiment of the bra hanger.
Figure 3:
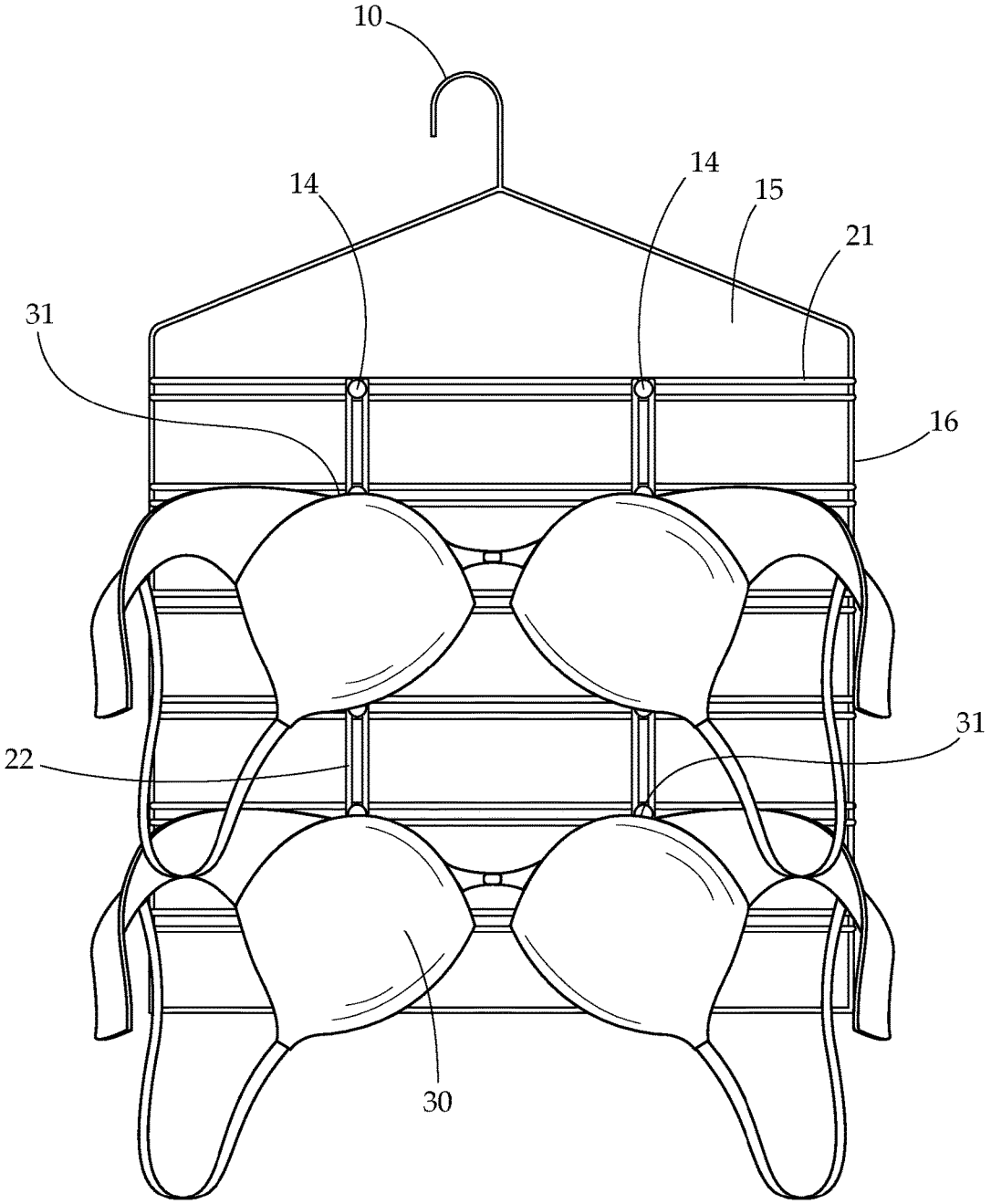
FIG. 3 provides an elevation view of yet another embodiment of the bra hanger.

FIGS. 2 and 3 provide another embodiment of the magnetic bra hanger. In this embodiment, a hanger 10 is configured as a hook sized to fit over a door, closet rack, bar, or the like. A magnetic hanging area 15 is defined by wire 16 that forms a partially rectangular border and attaches to the hanger 10. A plurality of horizontal bars 21 and vertical bars 22 span the magnetic hanging area 15 and are attached to wire 16, forming a grid. A plurality of magnets 14 are disposed at intersections of the horizontal and vertical bars 21, 22. However, it should be understood that the magnets 14 could be disposed at any location on the horizontal and vertical bars 21, 22.

A bra or bras 31 may be held by the hanger by magnetic attraction between the magnet 14 and underwire of the bra 31. The bras 31 may be arranged horizontally, or vertically. As shown in FIG. 3, a plurality of bras 31 may be attached to the hanger, each on a horizontal row of magnets 14.

Figure 4:
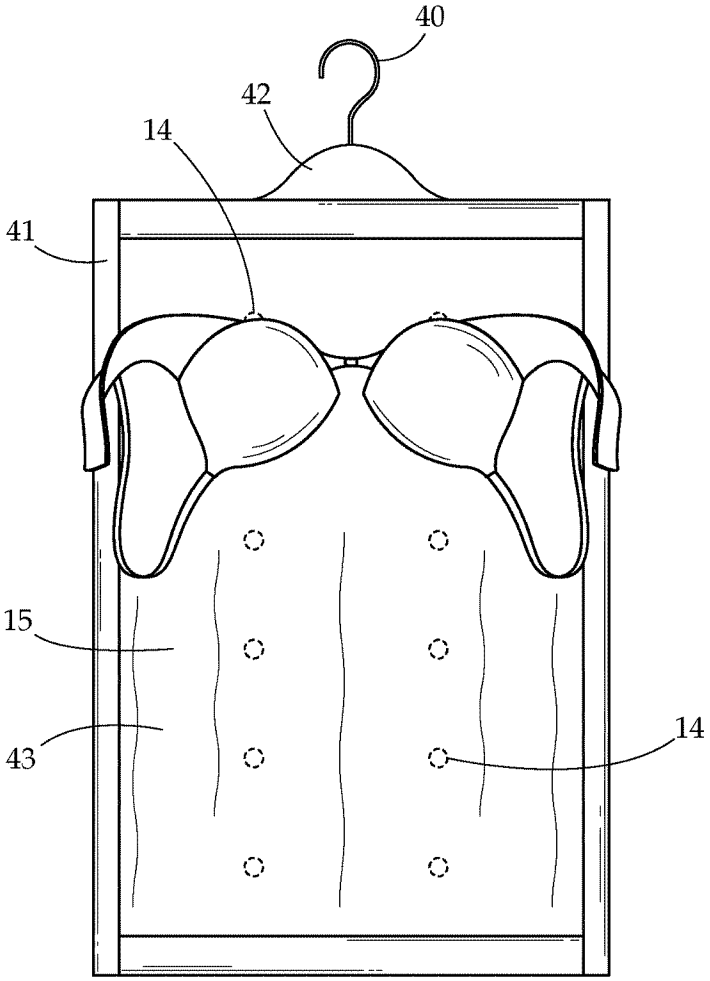
FIG. 4 provides an elevation view of still another embodiment of the bra hanger.

FIG. 4 provides another embodiment of the magnetic bra hanger. In this embodiment, a hanger 40 is shaped as a hook. The hanger 40 is attached to the magnetic hanging area 15 by a hanger support 42. This embodiment has the magnetic hanging area 15 formed as a flexible sheet 43 with magnets 14 embedded within the sheet 43. An optional border 41 may extend around the side and top edges of the sheet 43. This border 41 may be formed of any material. In one embodiment, the top borders 41 may be a rigid or semi-rigid material to provide structural support to the magnetic bra hanger. This structural support ensures that the flexible sheet 43 does not sag or fold when hanging bras. The side borders 41 may be flexible to allow for folding or rolling of the sheet 43. These side borders 41 may be formed of a flexible material biased to an unrolled, open position.

In a particular embodiment of FIG. 4, the sheet 43 may be smooth and have the magnets 14 embedded therein without protruding from the sheet or causing lumps in the sheet 43. This may add to the ease of use of the device. The flush orientation may be achieved by a thick piece of plastic, or the use of a foam or other spacer to seat the magnets 14 without their sides extending past the foam. The sheet may cover or expose the magnets, depending on embodiment, but in this embodiment will show no protrusions from the sheet surface.

Figure 5:
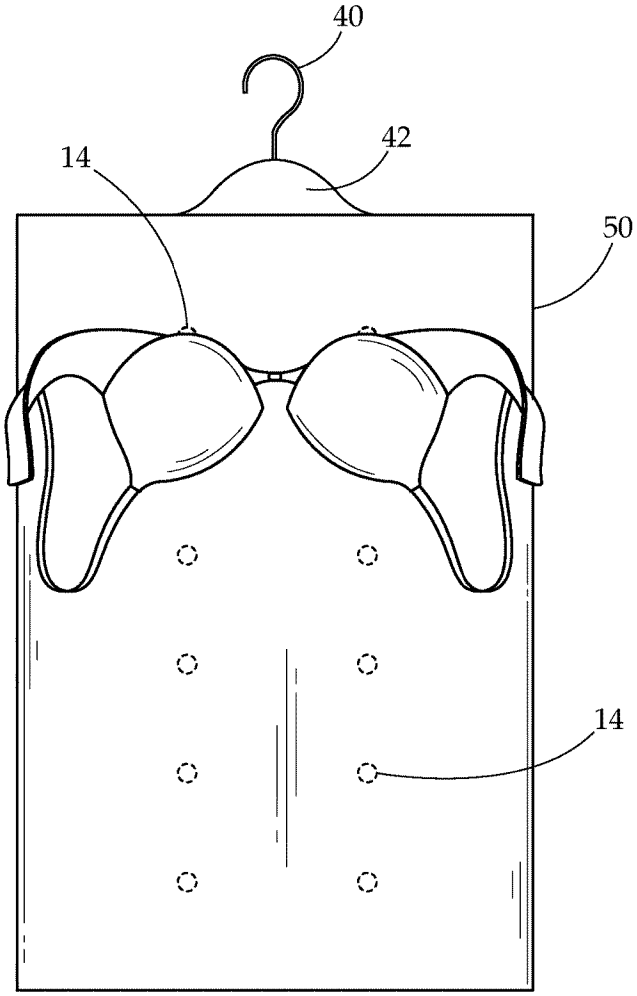
FIG. 5 provides an elevation view of still yet another embodiment of the bra hanger.

FIG. 5 provides still another embodiment of the magnetic bra hanger. The hanger 40 is attached to the magnetic hanging area 50 by a hanger support 42. This embodiment involves a magnetic hanging area 50 formed as a rigid or semi-rigid sheet. Magnets 14 are embedded in the sheet 50 and in some embodiments are flush with an edge of the sheet, or covered by the sheet.

While several variations of the present invention have been illustrated by way of example in preferred or particular embodiments, it is apparent that further embodiments could be developed within the spirit and scope of the present invention, or the inventive concept thereof. However, it is to be expressly understood that such modifications and adaptations are within the spirit and scope of the present invention, and are inclusive, but not limited to the following appended claims as set forth.

What is claimed is:

1. A magnetic bra hanger system comprising:

a hanger; and a magnetic hanging area attached to the hanger, the magnetic hanging area comprising:

a quantity of material defining the magnetic hanging area, the quantity of material sized to receive a bra; and a magnet directly mounted to the quantity of material, the magnet constructed and arranged to attract an underwire of a bra; and a bra having a first underwire, the first underwire directly connected to the magnetic bra hanger by magnetic attraction to the magnet.

2. The magnetic bra hanger system of claim 1 further comprising a plurality of magnets attached to the quantity of material.

3. The magnetic bra hanger system of claim 2 wherein the plurality of magnets are arranged in a plurality of rows along the quantity of material, at least one of the plurality of magnets in each row.

4. The magnetic bra hanger system hanger of claim 1 wherein the quantity of material is a flexible sheet capable of being rolled into a compact mode.

5. The magnetic bra hanger system of claim 1 wherein the quantity of material is formed as a grid having an outer perimeter and an interior, the grid having at least one of a horizontal bar and a vertical bar spanning the interior.

6. The magnetic bra hanger system of claim 2 wherein the plurality of magnets are arranged horizontally.

7. The magnetic bra hanger system of claim 1 further comprising a strap attachment mechanism connected to the quantity of material defining the magnetic hanging area.

8. A magnetic bra hanger system comprising:

a hanger;

a magnetic hanging area attached to the hanger, configured as a grid, the grid defining an outer perimeter and an interior, and having a horizontal bar spanning the interior and a vertical bar spanning the interior; and a magnet directly attached to the grid a bra having a first underwire, the first underwire directly connected to the magnetic bra hanger by magnetic attraction to the magnet, the bra in direct contact with the magnetic hanging area.

9. The magnetic bra hanger system of claim 8 further comprising a plurality of magnets attached to the grid.

10. The magnetic bra hanger system of claim 9 further comprising a plurality of horizontal bars spanning the interior of the grid, the plurality of magnets being attached to each of the plurality of horizontal bars.

11. The magnetic bra hanger system of claim 8 wherein the bra further comprises a second underwire on a different cup from the first underwire, the second underwire directly connected to the magnetic bra hanger by magnetic attraction between the second underwire and a second magnet directly attached to the grid.

12. The magnetic bra hanger system of claim 8 further comprising a sheet disposed over an exterior of the grid.

13. The magnetic bra hanger system of claim 9 wherein the plurality of magnets are arranged horizontally.

14. The magnetic bra hanger system of claim 9 wherein the plurality of magnets are arranged vertically.

15. A magnetic bra hanger system comprising:

a base panel;

a plurality of magnets attached to the base panel and arranged in rows about the base panel; and a bra having a first underwire on a first cup and a second underwire on a second cup, the first underwire directly attached to the magnetic bra hanger by magnetic attraction to a first of the plurality of magnets, the second underwire attached to the magnetic bra hanger by magnetic attraction to a second of the plurality of magnets.

16. The magnetic bra hanger system of claim 15 further comprising a bar slideably attached to the base panel.

17. The magnetic bra hanger system of claim 15 wherein the base panel is a fabric sheet.

18. The magnetic bra hanger system of claim 15 wherein the base panel is a wooden panel.

19. The magnetic bra hanger system of claim 15 further comprising a plurality of bras, each of the plurality of bras having a first underwire and a second underwire, each of the first underwires of the plurality of bras attached to one of the plurality of magnets, each of the second underwires of the plurality of bras attached to another of the plurality of magnets.

20. The magnetic bra hanger system of claim 17 further comprising a rigid framing attached to the fabric sheet.

* * * * *